United States Patent [19]

Millette

[11] 4,032,770

[45] June 28, 1977

[54] PORTABLE TABLE AND LAMP FIXTURE

[75] Inventor: Gloria Astrid Millette, Detroit, Mich.

[73] Assignee: The Raymond Lee Organization, Inc., New York, N.Y. ; a part interest

[22] Filed: Dec. 9, 1975

[21] Appl. No.: 639,215

[52] U.S. Cl. ..... 240/4; 240/67; 240/78 R

[51] Int. Cl.[2] ..... F21V 33/00; A47B 97/00

[58] Field of Search ..... 240/2 D, 2 AT, 2 W, 240/2.25, 4, 6, 17, 36, 37, 108 R, 62 B, 62.61, 62.62, 67, 78 CF, 78 HA, 149, 150, 70, 78 R, 71; 108/23, 125

[56] References Cited

UNITED STATES PATENTS

| | | | |
|---|---|---|---|
| 1,756,289 | 4/1930 | Harding | 240/20 |
| 1,961,087 | 5/1934 | Simms | 240/2 AT |
| 2,844,428 | 7/1958 | Puntennzy | 108/23 |
| 3,002,086 | 9/1961 | Reeber | 240/71 |
| 3,115,108 | 12/1963 | Craddock et al. | 108/125 |
| 3,382,819 | 5/1968 | Deutsch et al. | 240/4 |

FOREIGN PATENTS OR APPLICATIONS

| | | | |
|---|---|---|---|
| 31,914 | 7/1923 | Denmark | 240/67 |

*Primary Examiner*—Edna M. O'Connor
*Attorney, Agent, or Firm*—Howard I. Podell

[57] ABSTRACT

A portable table the underside of which is formed as a light fixture which is suspended by an electrical cable, so that in a first position the device may be suspended adjacent the ceiling of a room to serve as a light fixture, and in a second position, the table may be lowered to rest on folding legs off the floor of the room. In the lowered position light may project upward through a flat translucent plate mounted in the table.

2 Claims, 2 Drawing Figures

PORTABLE TABLE AND LAMP FIXTURE

SUMMARY OF THE INVENTION

My invention is a portable table the underside of which is formed as a light fixture which is suspended by an electrical cable, so that in a first position the device may be suspended adjacent the ceiling of a room to serve as a light fixture, and in a second position, the table may be lowered to rest on folding legs off the floor of the room.

One or more light sockets fitted with electric bulbs are mounted in a recess in the central section of a rectangular shaped base that serves as a table top and light fixture. A translucent dome is fitted on the underside of the base about this recess, with a flat translucent plate mounted to cover the top of the recess. An electric cable which is connected to the light sockets is fitted through the flat top plate for fastening to a pulley on a ceiling. The cable may be led to a winch reel or to a wall bracket for fastening in the desired position on the base.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
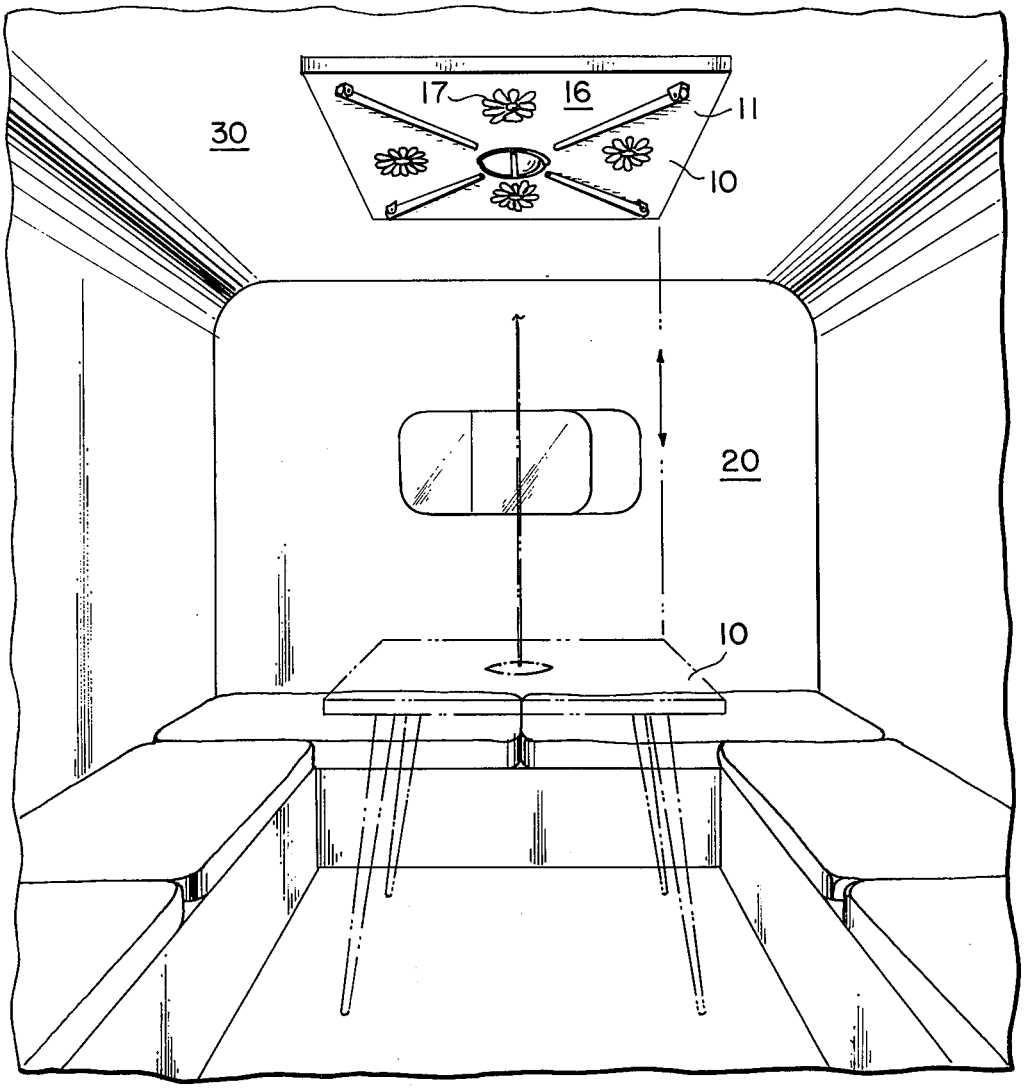
FIG. 1 is a perspective view of the invention.
Figure 2:
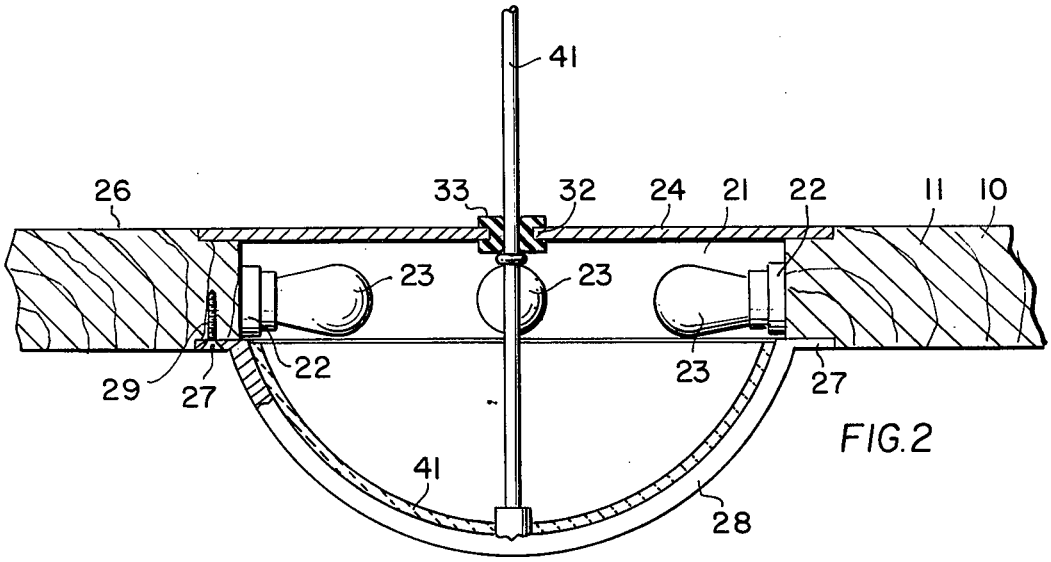
FIG. 2 is a fragmentary sectional view of the base of the invention.

Turning now descriptively to the drawings, in which similar reference characters denote similar elements throughout the several views, FIGS. 1–2 illustrate the device 10 of the invention which serves alternately as a lighting fixture, as shown in solid lines, or as a table, as shown in dash lines in FIG. 1.

The device 10 is formed with a rectangular base plate 11, with four folding legs pivotably mounted to the underside surface 16 of the base plate 11. The underside surface 16 may also be marked with decorations 17 that are visible when the device 10 is employed as a ceiling light fixture.

A central recess section 21 of the base plate is fitted with one or more light sockets 22 in which electric bulbs 23 are fitted.

The recess 21 is covered with a top translucent plate 24 that lies flush with the top surface 26 of the base plate 11, with a half dome shaped translucent plate 28 mounted underneath the recess 21. Edge flanges 27 of the dome plate 28 are mounted flush to the undersurface 16 of the base plate with screws 29 holding the dome plate in position. Removal of screws 29 permits removal of the dome plate 28 for access to the light bulb and sockets. Dome plate 28 may be perforated.

A flexible electric cable 41 connects all sockets and is led out through a central opening 32 fitted with a grommet 33 in the top plate 24 and led through a pulley (not shown) hung from a ceiling 30. The cable 41 may be fastened to a wall bracket (not shown) with the end of the cable connected to a wall electrical outlet.

As shown in FIG. 1, the device 10 is well suited for use in the cabin 20 of a camper or boat, serving as a table located between benches that convert to bunks when the device 10 is raised to the ceiling 30.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A combination light fixture and table assembly, which in a first position may be hung from a ceiling against the ceiling to serve as a source of illumination, and in a second position may be supported on foldable legs on a floor to serve both as a table and as a source of illumination, comprising a table unit formed of a table top joined on its underside to foldable legs, said table top fitted with a lamp unit that is fixed to the table top in a through opening in the said table top, said lamp unit formed of a top plate that is mounted to said table top in said opening so that the upper surface of the said top plate forms a continuation of the surface of the table top, and a shell that extends below the lower surface of said table top, with said top plate and said shell enclosing an interior chamber in which an electric light bulb socket is fixed, with said top plate and said shell each formed of light transmitting material so that a light bulb mounted in the socket casts light above the table and below the table, said socket connected to a flexible electric cable that extends through the said top plate, which cable serves as the means to suspend the assembly from a ceiling in said first position.

2. The combination as recited in claim 1 in which the lamp unit is centrally mounted in the table top, with the electric cable extending through a centrally located opening in the top plate to serve as the sole means of suspension support to the assembly.

* * * * *